US009869947B2

(12) United States Patent
Shirai

(10) Patent No.: US 9,869,947 B2
(45) Date of Patent: Jan. 16, 2018

(54) TONER CONTAINER AND IMAGE FORMING APPARATUS

(71) Applicant: KYOCERA Document Solutions Inc., Osaka (JP)

(72) Inventor: Wataru Shirai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 17 days.

(21) Appl. No.: 15/219,458

(22) Filed: Jul. 26, 2016

(65) Prior Publication Data

US 2017/0031270 A1 Feb. 2, 2017

(30) Foreign Application Priority Data

Jul. 30, 2015 (JP) ..... 2015-150818

(51) Int. Cl.
*G03G 15/08* (2006.01)

(52) U.S. Cl.
CPC . *G03G 15/0863* (2013.01); *G03G 2215/0695* (2013.01)

(58) Field of Classification Search
CPC ..... G03G 15/0863; G03G 2215/0695; G03G 2215/0697
See application file for complete search history.

(56) References Cited

U.S. PATENT DOCUMENTS

2002/0021909 A1* 2/2002 Harumoto ..... G03G 15/0865 399/27
2011/0075214 A1* 3/2011 Murayama ..... G03G 21/1882 358/1.15
2012/0274992 A1* 11/2012 Suzuki ..... G03G 21/1885 358/474

FOREIGN PATENT DOCUMENTS

JP 05128319 A * 5/1993
JP 2006-030472 A 2/2006

* cited by examiner

*Primary Examiner* — Erika J Villaluna
(74) *Attorney, Agent, or Firm* — Studebaker & Brackett PC

(57) ABSTRACT

A toner container is attachably and detachably formed at a container-attaching part of an image forming apparatus, and includes a first IC tag. The first IC tag is arranged on a circumferential surface of the toner container. The first IC tag makes communication with a reader arranged at the container-attaching part when the toner container is attached to the container-attaching part. The first IC tag cannot make communication with the reader when a distance between the first IC tag and the reader is less than a threshold distance (for example, less than 2 mm). With the first IC tag being arranged at a position opposite to the reader, the distance (for example, 1 mm) between the first IC tag and the reader is shorter than the threshold distance. The first IC tag is arranged at a position separate from the position opposite to the reader.

5 Claims, 6 Drawing Sheets

TONER CONTAINER AND IMAGE FORMING APPARATUS

INCORPORATION BY REFERENCE

The present application claims priority under 35 U.S.C. § 119 to Japanese Patent Application No. 2015-150818, filed Jul. 30, 2015. The contents of this application are incorporated herein by reference in their entirety.

BACKGROUND

This disclosure relates to a toner container and an image forming apparatus.

Typically known are various technologies of arranging an IC tag of a toner container in an image forming apparatus.

For example, an image forming apparatus is known which has IC tags respectively attached to top parts of side surfaces of bodies of a plurality of toner containers. The IC tags are attached in a manner such as to be arranged alternately at a far side and a near side of the side surfaces of the bodies of the plurality of toner containers. Also a reader with an antenna which makes communication with the IC tag is arranged at a position opposite to the IC tag.

With the image forming apparatus described above, a distance between the plurality of IC tags described above can be increased to such a distance that permits prevention of signal interference between the plurality of IC tags.

SUMMARY

A toner container according to a first aspect of this disclosure is a toner container attachably and detachably formed at a container-attaching part of an image forming apparatus, and includes a first IC tag. The first IC tag is arranged on a circumferential surface of the toner container. The first IC tag makes communication with a reader arranged at the container-attaching part when the toner container is attached to the container-attaching part. The first IC tag cannot make communication with the reader when a distance between the first IC tag and the reader is less than a threshold distance. With the first IC tag being arranged at a position opposite to the reader, the distance between the first IC tag and the reader is shorter than the threshold distance. The first IC tag is arranged at a position separate from the position opposite to the reader.

An image forming apparatus according to a second aspect of this disclosure includes: the container-attaching part; and the reader. The toner container is attached to the container-attaching part.

BRIEF DESCRIPTION OF THE DRAWINGS

FIG. 2A is a side view showing the first IC tag arranged on the circumferential surface of the toner container. FIG. 2B is a side view showing the second IC tag arranged on the circumferential surface of the toner container.

FIG. 3A is a transparent plan view thereof. FIG. 3B is a side view thereof.

DETAILED DESCRIPTION

Figure 1:
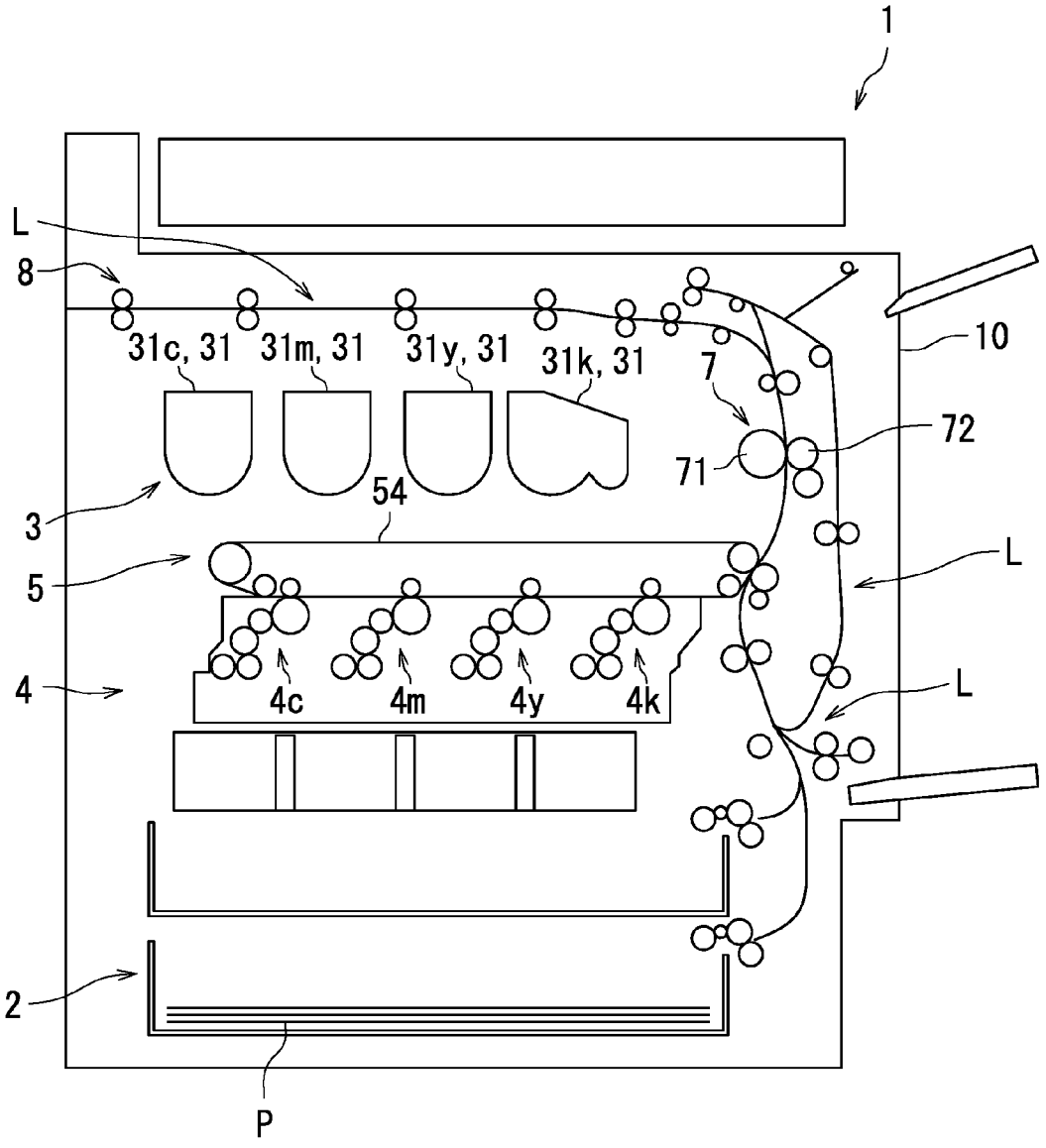
FIG. 1 is a side view showing configuration of an image forming apparatus according to an embodiment of this disclosure.

Hereinafter, an embodiment of this disclosure will be described with reference to the drawings (FIGS. 1-6). Note that the same or corresponding portions are provided with the same reference numerals and their repeated description will be omitted.

First, with reference to FIG. 1, an image forming apparatus 1 according to the present embodiment will be described. FIG. 1 is a diagram showing configuration of the image forming apparatus 1 according to the present embodiment. In the present embodiment, the image forming apparatus 1 is a color copier.

As shown in FIG. 1, the image forming apparatus 1 is an apparatus that forms an image on paper P. The image forming apparatus includes a housing 10, a paper feed section 2, a conveyance section L, a toner supplying unit 3, an image forming section 4, a transfer section 5, a fixing section 7, and an ejecting section 8.

The paper feed section 2 is arranged at a bottom of the housing 10, and supplies paper P to the conveyance section L. The paper feed section 2 can store a plurality of pieces of paper P, and supplies the pieces of paper P one at a time to the conveyance section L, starting with the one located at a top.

The conveyance section L conveys the paper P, which has been supplied by the paper feed section 2, to the ejecting section 8 via the transfer section 5 and the fixing section 7.

The toner supplying unit 3 is a container that supplies toners to the image forming section 4, and includes four toner containers 31*c*, 31*m*, 31*y*, and 31*k*. The toner container 31*m* stores the toner of a cyan color. The toner container 31*m* stores the toner of a magenta color. The toner container 31*y* stores the toner of a yellow color. The toner container 31*k* stores the toner of a black color. In the description below, the toner containers 31*c*, 31*m*, 31*y*, and 31*k* may collectively be referred to as a toner container 31.

The transfer section 5 includes an intermediate transfer belt 54. The transfer section 5 transfers, on the paper P, a toner image formed on the intermediate transfer belt 54 by the image forming section 4.

The image forming section 4 forms the toner image on the intermediate transfer belt 54. More specifically, the image forming section 4 includes four image forming sections 4*c*, 4*m*, 4*y*, and 4*k*. To the image forming section 4*c*, the cyan toner is supplied from the toner container 31*c*. To the image forming section 4*m*, the magenta toner is supplied from the toner container 31*m*. To the image forming section 4*y*, the yellow toner is supplied from the toner container 31*y*. To the image forming section 4*k*, the black toner is supplied from the toner container 31*k*.

The fixing section 7 is a roller pair that fixes the toner image formed on the paper P by the transfer section 5, and includes a heating roller 71 and a pressure roller 72. The paper P is heated and pressed by the heating roller 71 and the pressure roller 72. As a result, the non-fixed toner image transferred on the paper P at the transfer section 5 is fixed by the fixing section 7. The ejecting section 8 ejects the paper P, on which the toner image has been fixed, to an outside of the image forming apparatus 1.

Figure 2A:
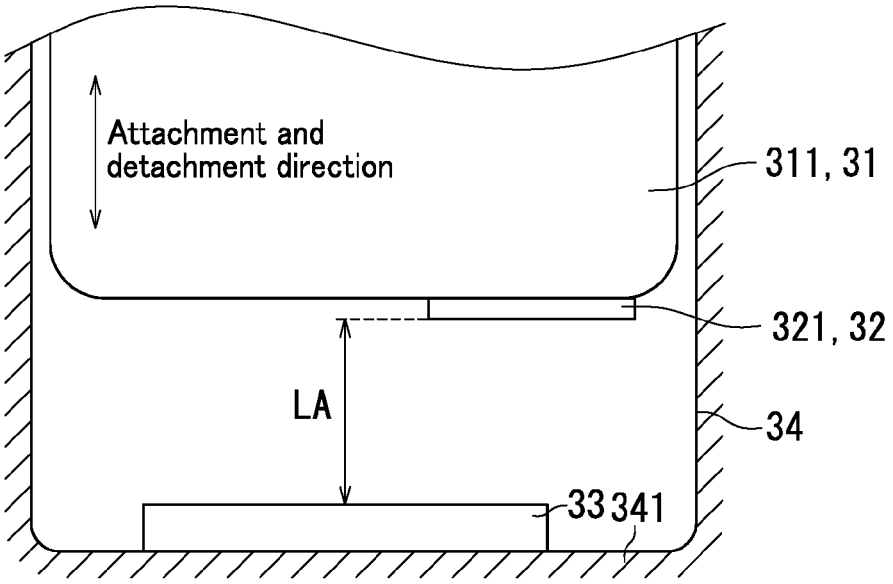
FIGS. 2A and 2B are side views showing IC tags arranged on circumferential surfaces of toner containers shown in FIG. 1.
Figure 2B:
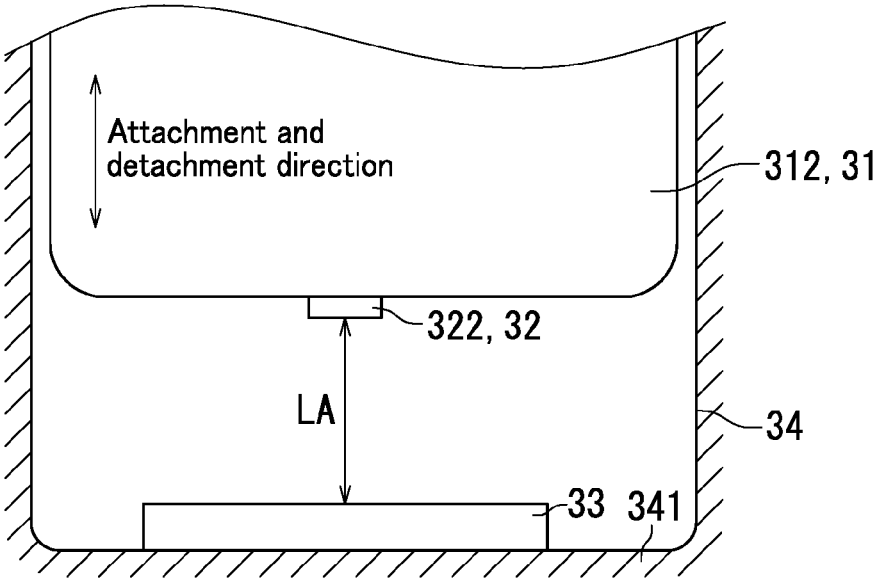

Next, with reference to FIGS. 2A and 2B, IC tags 32 arranged on circumferential surfaces of the toner containers 31 will be described. FIGS. 2A and 2B are side views showing the IC tags 32 arranged on the circumferential surfaces of the toner containers 31.

The image forming apparatus 1 has a container-attaching part 34. The container-attaching part 34 is configured in a manner such that the toner container 31 is attachable thereto and detachable therefrom. At the container-attaching part 34, a reader 33 is arranged. The toner container 31 has the IC tag 32 arranged on its circumferential surface. The reader 33 makes communication with the IC tag 32 when the toner container 31 is attached to the container-attaching part 34.

The IC tag 32 is arranged on the circumferential surface of the toner container 31. More specifically, the IC tag 32 is arranged, for example, on an end surface on one side (a lower-side end surface in FIGS. 2A and 2B) in a direction in which the toner container 31 is attached or detached (in a vertical direction in FIGS. 2A and 2B). The IC tag 32 stores identification information of the toner container 31. Specifically, the identification information of the toner container 31 includes at least one of information of a manufacturer's production serial number of the toner container 31, information of a manufacturing date of the toner container 31, identification information of a manufacturing plant of the toner container 31, and property value information of the toner stored in the toner container 31.

The toner containers 31 include: a first toner container 311 and a second toner container 312. The first toner container 311 and the second toner container 312 are separate toner containers 31 having the same shape. The IC tags 32 include a first IC tag 321 and a second IC tag 322. The first IC tag 321 is arranged on the circumferential surface of the first toner container 311. The second IC tag 322 is arranged on the circumferential surface of the second toner container 312.

FIG. 2A is the side view showing the first IC tag 321 arranged on the circumferential surface of the first toner container 311. FIG. 2B is the side view showing the second IC tag 322 arranged on the circumferential surface of the second toner container 312. The first IC tag 321, as shown in FIG. 2A, is arranged at a position on the circumferential surface of the first toner container 311 separate from a position opposite to the reader 33. The second IC tag 322, as shown in FIG. 2B, is arranged at a position on the circumferential surface of the second toner container 312 opposite to the reader 33.

The first IC tag 321 can make communication with the reader 33 within a range of a first communicable distance from a position of the reader 33. The second IC tag 322 can make communication with the reader 33 within a range of a second communicable distance, which is shorter than the first communicable distance, from the position of the reader 33.

The reader 33 is arranged on a wall surface 341 on one side forming the container-attaching part 34 (a side below the toner container 31 in FIGS. 2A and 2B). Moreover, the reader 33 reads the identification information of the first toner container 311 stored in the first IC tag 321. Further, the reader 33 reads the identification information of the second toner container 312 stored in the second IC tag 322.

Figure 3A:
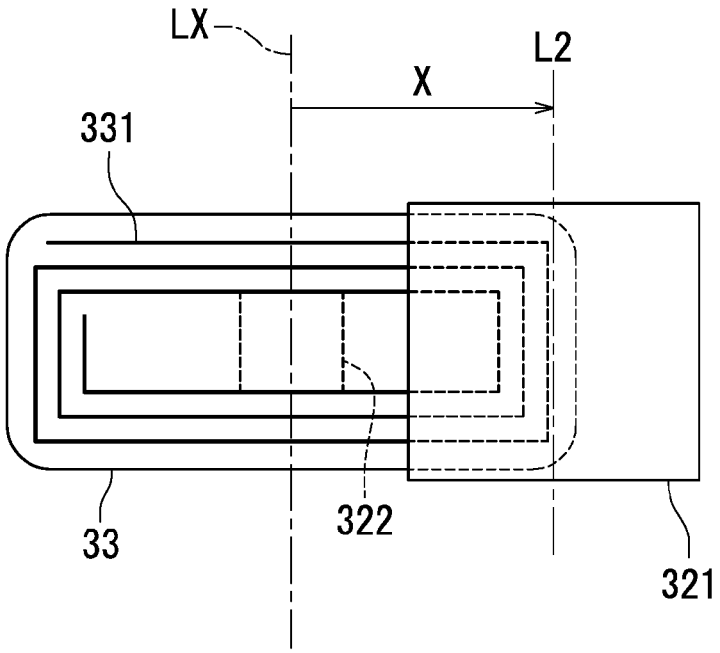
FIGS. 3A and 3B are diagrams showing positional relationship between the IC tags shown in FIGS. 2A and 2B and a reader.
Figure 3B:
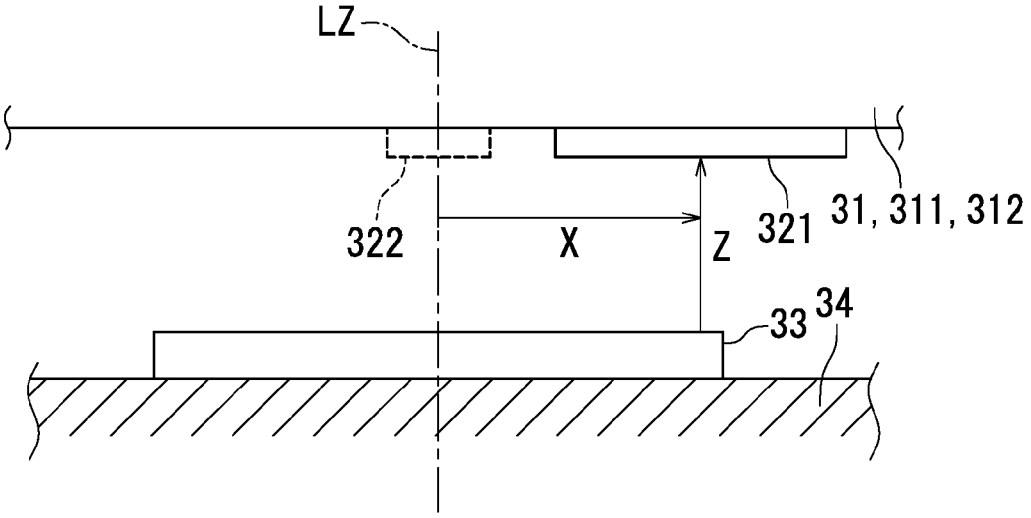

Next, with reference to FIGS. 3A and 3B, coordinates showing attached positions of the IC tags 32 according to the present embodiment will be described. FIGS. 3A and 3B are diagrams showing positional relationship between the IC tags 32 shown in FIGS. 2A and 2B and the reader 33. FIG. 3A is a transparent plan view showing the positional relationship between the IC tags 32 and the reader 33. FIG. 3B is a side view showing the positional relationship between the IC tags 32 and the reader 33.

As shown in FIG. 3A, an antenna 331 is arranged at the reader 33. The antenna 331 performs radio wave transmission and reception for the purpose of making communication with the IC tags 32. The antenna 331 is formed in a spiral form clockwise from an outer circumference side to an inner circumference side of the reader 33. Moreover, the reader 33 is formed into a rectangular shape, and outer circumference of the antenna 331 is formed into a substantially rectangular shape. In FIG. 3A, a center line LX divides a long side of the reader 33 in half. With a position of the center line LX as the origin, a direction along the long side of the reader 33 (a horizontal direction in FIGS. 3A and 3B) is defined as an X-axis.

Moreover, in the present embodiment, the first IC tag 321 is arranged at the position separate from a center point of the position opposite to the reader 33 in a longitudinal (horizontal in FIG. 3A) direction of the reader 33. The first communicable distance AR1 of the first IC tag 321 is longer than the second communicable distance AR2 of the second IC tag 322. In FIG. 3A, a center line L2 is a center line of the IC tag 32 (the first IC tag 321 in FIG. 3A) in a direction parallel to the center line LX. An X-coordinate of the center line L2 is defined as an X-coordinate of the IC tag 32 (the first IC tag 321).

FIG. 3B shows a center line LZ of the reader 33 in a direction (thickness direction) orthogonal to a surface of the reader 33 opposite to the IC tag 32. A position of the surface of the reader 33 on a side opposite to the IC tag 32 (an upper side of the reader 33 in FIG. 3B) is defined as the origin of a Z-axis. Then the Z-axis is defined in a direction which is parallel to the center line LZ and directed from the reader 33 to the first IC tag 321 (upwardly in FIG. 3B). AZ-coordinate of a surface of the IC tag 32 on a side opposite to the reader 33 (a lower surface of the IC tag 32 in FIG. 3B) is defined as a Z-coordinate of the IC tag 32.

Figure 4:
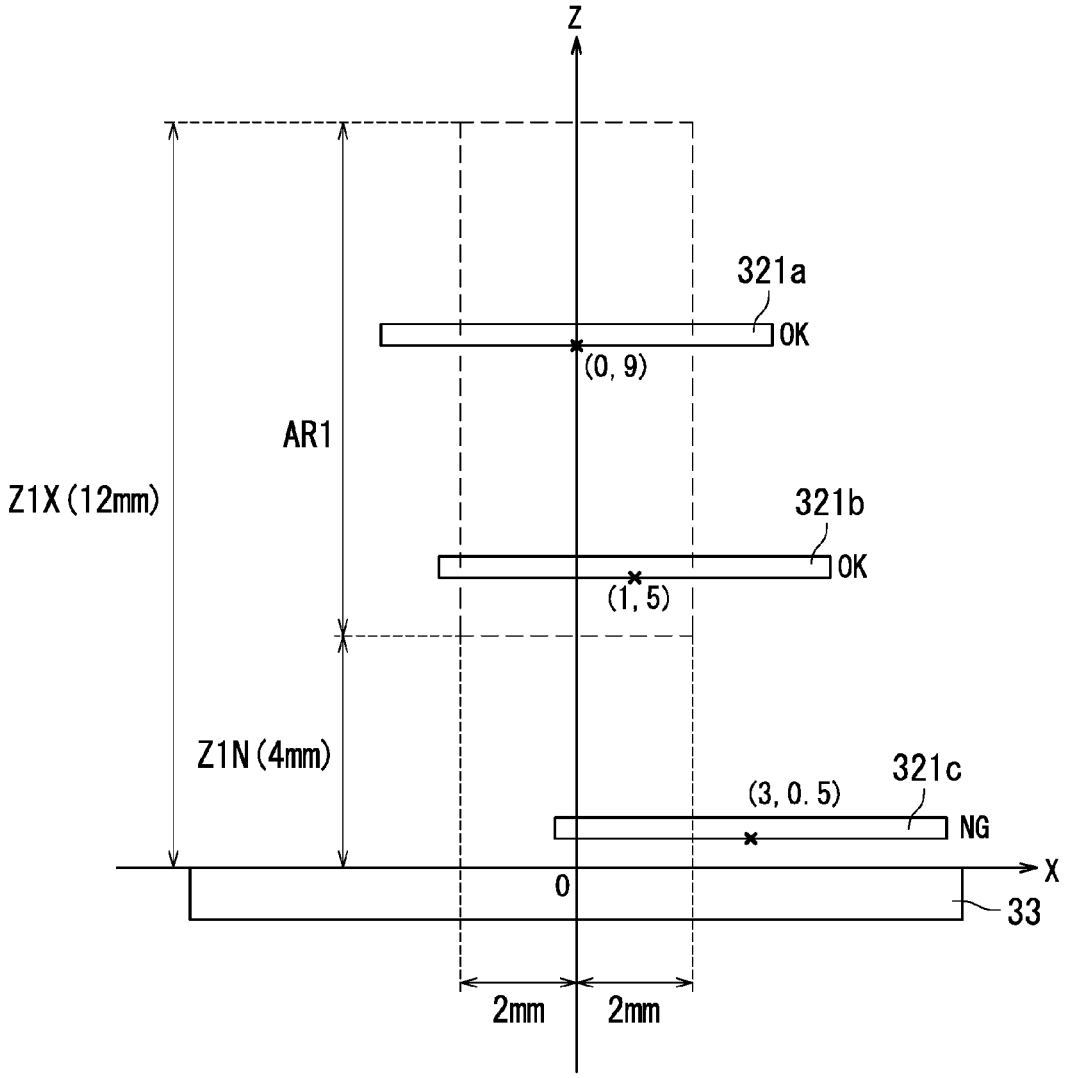
FIG. 4 is a diagram showing a communicable distance of the first IC tags.

Next, with reference to FIG. 4, the first communicable distance AR1 of the first IC tag 321 will be described. FIG. 4 is a diagram showing the first communicable distance AR1 of the first IC tag 321. A horizontal axis of FIG. 4 represents an X-axis and a vertical axis of FIG. 4 represents a Z-axis. The first communicable distance AR1 of the first IC tag 321 is a distance over which communication with the reader 33 can be made. Note that it is assumed that the X-coordinate of the first IC tag 321 is within a predetermined range (for example, −2 mm to 2 mm). A position of the first IC tag 321 is expressed by coordinates (X, Z) at a center position of the surface of the first IC tag 321 on the side opposite to the reader 33 (the lower surface of the first IC tag 321 in FIG. 4). The first IC tag 321 is one example of IC tags 32 communicable distance of which is longer than that of the second IC tag 322. The first communicable distance AR1 of the first IC tag 321 is a distance from a shortest distance Z1N (for example, 4 mm) to a longest distance Z1X (for example, 12 mm).

FIG. 4 shows a first IC tag 321*a*, a first IC tag 321*b*, and a first IC tag 321*c*. The first IC tag 321*a* is the first IC tag 321 arranged at coordinates (0, 9). The first IC tag 321*b* is the first IC tag 321 arranged at coordinates (1, 5). The first IC tag 321*c* is the first IC tag 321 arranged at coordinates (3, 0.5).

Since the first communicable distance AR1 of the first IC tag 321 is from 4 mm to 12 mm, the first IC tag 321*a* can make communication with the reader 33. Similarly, the first IC tag 321*b* can make communication with the reader 33. On the other hand, the first IC tag 321*c* is at a position closer to the reader 33 than the shortest distance Z1N (4 mm) of the first communicable distance AR1 of the first IC tag 321. Therefore, the first IC tag 321*c* cannot make communication with the reader 33.

The reason why the communication between the first IC tag 321 and the reader 33 cannot be made when the distance between the first IC tag 321 and the reader 33 is less than the shortest distance Z1N of the first communicable distance AR1 is that a non-sensing region called a "null point" is formed. The "null point" is caused by a phenomenon that radio waves emitted from the antenna 331 of the reader 33 and waves reflected from the IC tag 32 (or the circumferential surface of the toner container 31) interfere with and cancel out each other. The aforementioned phenomenon is called "fading".

Figure 5:
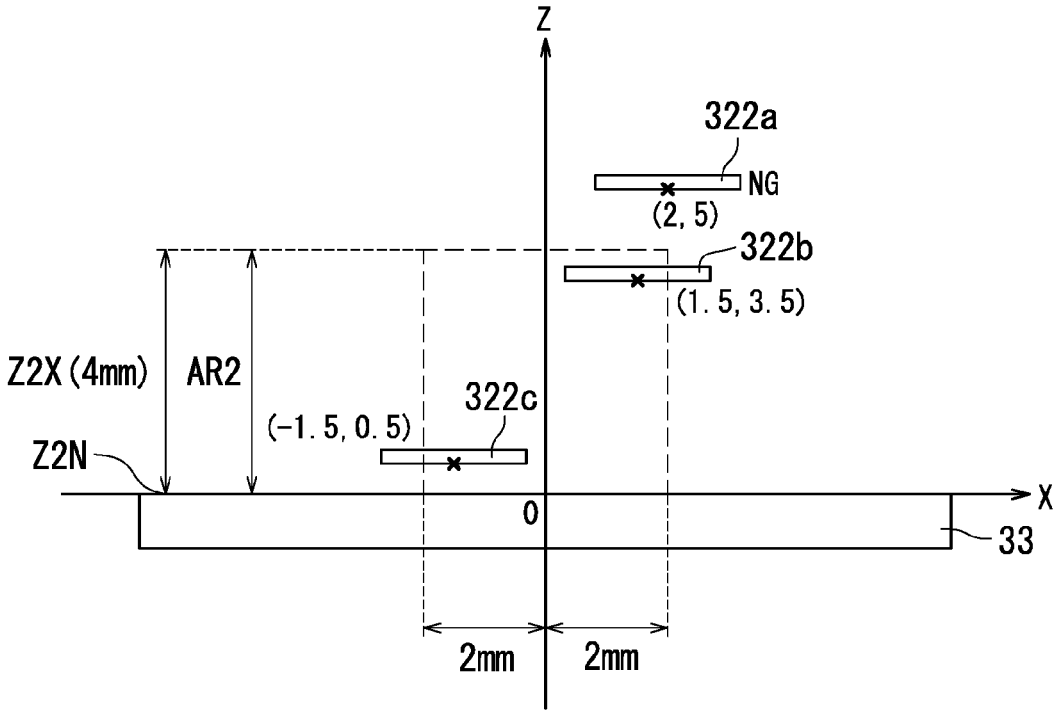
FIG. 5 is a diagram showing a communicable distance of the second IC tags.

Next, with reference to FIG. 5, the communicable distance of the second IC tag 322 will be described. FIG. 5 is a diagram showing the second communicable distance AR2 of the second IC tag 322. A horizontal axis of FIG. 5 represents an X-axis and a vertical axis of FIG. 5 represents a Z-axis. The second communicable distance AR2 of the second IC tag 322 is a distance over which communication with the reader 33 can be made. Note that it is assumed that an X-coordinate of the second IC tag 322 is within a predetermined range (for example, −2 mm to 2 mm). A position of the second IC tag 322 is expressed by coordinates (X, Z) at a center position of the surface of the second IC tag 322 on the side opposite to the reader 33 (a lower surface of the second IC tag 322 in FIG. 5). The second IC tag 322 is one example of IC tags 32 communicable distance of which is shorter than that of first IC tag 321. The second communicable distance AR2 of the second IC tag 322 is from a shortest distance Z2N (for example, zero mm) to a longest distance Z2X (for example, 4 mm).

FIG. 5 shows a second IC tag 322*a*, a second IC tag 322*b*, and a second IC tag 322*c*. The second IC tag 322*a* is the second IC tag 322 arranged at coordinates (2, 5). The second IC tag 322*b* is the second IC tag 322 arranged at coordinates (1.5, 3.5). The second IC tag 322*c* is the second IC tag 322 arranged at coordinates (−1.5, 0.5).

Since the second communicable distance AR2 of the second IC tag 322 is from zero mm to 4 mm, the second IC tag 322*c* can make communication with the reader 33. Similarly, the second IC tag 322*b* can make communication with the reader 33. On the other hand, a distance between the second IC tag 322*a* and the reader 33 is longer than the longest distance Z2X (4 mm) of the second communicable distance AR2 of the second IC tag 322. Therefore, the second IC tag 322*a* cannot make communication with the reader 33.

As described above, the first communicable distance AR1 of the first IC tag 321 is from 4 mm to 12 mm, and the second communicable distance AR2 of the second IC tag 322 is from zero mm to 4 mm. Therefore, to arrange the first IC tag 321 on the first toner container 311 and arrange the second IC tag 322 on the second toner container 312, a distance between the IC tag 32 and the reader 33 needs to be set at 4 mm.

For example, in a case where the distance between the IC tag 32 and the reader 33 is set at 4 mm, when a fluctuation in the distance between the IC tag 32 and the reader 33 occurs, there is a risk that the reader 33 cannot make communication with the IC tag 32. Therefore, in the present embodiment, a distance LA between the IC tag 32 and the reader 33 is set at a length (2 mm in the present embodiment) of a distance between a center position of the second communicable distance AR2 of the second IC tag 322 and the reader 33. Moreover, the second IC tag 322 is arranged at the position opposite to the reader 33. In other words, the second IC tag 322 is arranged in a manner such that a center position of its surface on the side opposite to the reader 33 (the lower surface of the second IC tag 322 in FIG. 5) is at coordinates (0.2).

As described above, the length of the distance LA between the IC tag 32 and the reader 33 is set based on the second communicable distance AR2 of the second IC tag 322. In other words, the length of the distance LA is set based on the shortest distance 77N and the longest distance 77X of the second communicable distance AR2 of the second IC tag 322. Therefore communication between the second IC tag 322 with the short second communicable distance AR2 and the reader 33 can reliably be performed.

Moreover, since the IC tag 32 (second IC tag 322) with the short second communicable distance AR2 is arranged at the position opposite to the reader 33, the communication between the second IC tag 322 and the reader 33 can more reliably be performed.

Figure 6:
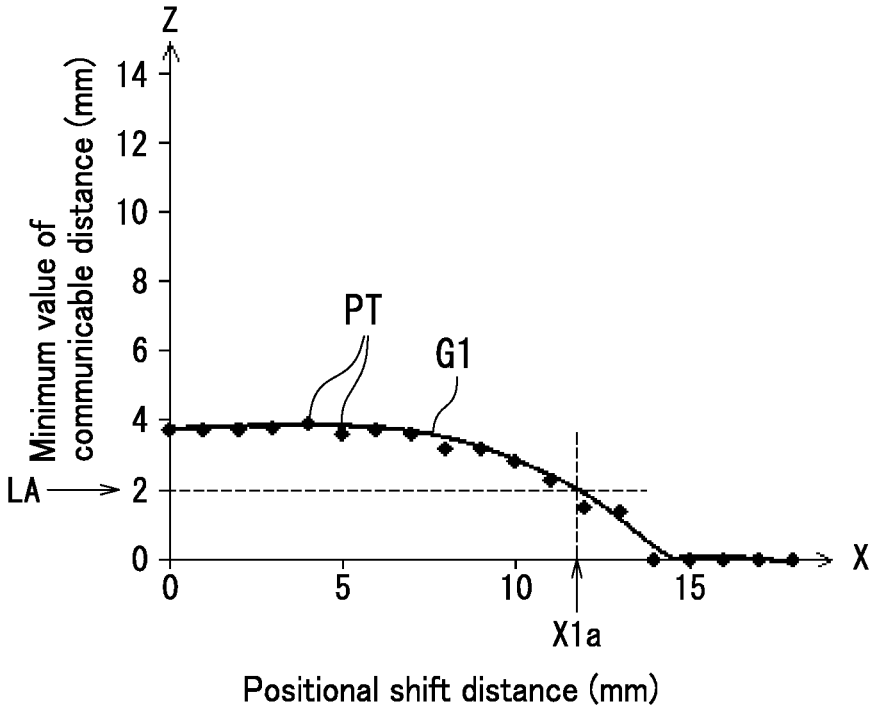
FIG. 6 is a graph showing relationship between a positional shift distance of the first IC tag from a position opposite to the reader and a shortest distance of the communicable distance.

Next, with reference to FIG. 6, the position at which the first IC tag 321 is arranged will be described. FIG. 6 is a graph G1 showing relationship between a positional shift distance ΔX of the first IC tag 321 from the position opposite to the reader 33 and the shortest distance Z1N of the first communicable distance AR1. The first IC tag 321 is so arranged as to be shifted in an X-axis direction from the position opposite to the reader 33. The positional shift distance ΔX is an X-coordinate indicating the position of the first IC tag 321. A horizontal axis represents the positional shift distance ΔX, and a vertical axis represents the shortest distance Z1N of the first communicable distance AR1 of the first IC tag 321. Black diamond-shaped marks PT in the figure represent experimental results.

As shown in the graph G1, with an increase in the positional shift distance ΔX, the shortest distance Z1N of the first communicable distance AR1 decreases monotonously. Then with a positional shift distance ΔX of 12 mm, the shortest distance Z1N of the first communicable distance AR1 agrees with the distance LA (2 mm in the present embodiment). In other words, the first IC tag 321 and the reader 33 can make communication with each other. Further, with a positional shift distance ΔX of 14 mm, the shortest distance Z1N of the first communicable distance AR1 reaches zero mm.

Note that, although not shown in FIG. 6, when a positional shift distance ΔX is 19 mm or more, the communication between the first IC tag 321 and the reader 33 became impossible.

Based on the experimental results shown in FIG. 6, when the positional shift distance ΔX of the first IC tag 321 is set in a range from 14 mm to 18 mm, the shortest distance Z1N of the first communicable distance AR1 becomes zero mm. Therefore, for example, setting the positional shift distance ΔX of the first IC tag 321 at 16 mm permits stable communication between the first IC tag 321 and the reader 33 even in a case where the distance LA between the IC tag 32 and the reader 33 is 2 mm.

As described with reference to FIGS. 2A-6, the IC tag 32 has typically been arranged at the position opposite to the reader 33. In this case, the first IC tag 321 having the long first communicable distance AR1 may have been unusable in some cases. The first communicable distance AR1 is the distance between the first IC tag 321 and the reader 33 and a distance over which the first IC tag 321 can make communication with the reader 33.

In other words, when the distance between the first IC tag 321 and the reader 33 is less than a preset threshold distance, the communication between the first IC tag 321 and the reader 33 cannot be made. The threshold distance is the shortest distance Z1N (for example, 4 mm) of the first communicable distance AR1 of the first IC tag 321. Moreover, in a case where the first IC tag 321 is arranged at the position opposite to the reader 33, the distance LA (for example, 2 mm) between the first IC tag 321 and the reader 33 is shorter than the threshold distance (4 mm).

In such a case, arranging the first IC tag 321 at a position separate from the position opposite to the reader 33 enables the communication between the first IC tag 321 and the reader 33. For example, the first IC tag 321 is arranged at a position separate from the position opposite to the reader 33 in a direction along a long side of the antenna 331 disposed on the reader 33.

Moreover, the first IC tag 321 can make communication with the reader 33 within the range of the first communicable distance AR1 from the position of the reader 33. On the other hand, a longer first communicable distance AR1 results in a longer shortest distance Z1N of the first communicable distance AR1. Moreover, the first IC tag 321 is arranged at a longer distance (with a positional shift distance ΔX) from the position opposite to the reader 33, as the first communicable distance AR1 increases. This therefore enables the communication between the first IC tag 321 and the reader 33. For example, with a longer first communicable distance AR1, the first IC tag 321 is arranged at a position more separate from the position opposite to the reader 33 in the direction along the long side of the antenna 331.

Further, the first IC tag 321 is arranged at the position separate from the position opposite to the reader 33 in the direction along the long side of the antenna 331. This therefore enables the stable communication between the first IC tag 321 and the reader 33, based on the experimental results shown in FIG. 6.

The second IC tag 322 can make communication with the reader 33 within the range of the second communicable distance AR2, which is shorter than the first communicable distance AR1, from the position of the reader 33. Moreover, a distance between the reader 33 and the circumferential surface of the toner container 31 is set based on the range of the second communicable distance AR2. This therefore permits the second IC tag 322 to make communication with the reader 33. In other words, by arranging the second IC tag 322 having the shorter communicable distance than the first IC tag 321 at the position of the toner container 31 opposite to the reader 33, the communication between the second IC tag 322 and the reader 33 is enabled.

With reference to the drawings, the embodiment of this disclosure has been described above. Note that, however, this disclosure is not limited to the embodiment described above, and it can be carried out in various modes within a range not departing from its spirits (for example, shown in (1)-(7) below). The drawings primarily and schematically show the components for easier understanding, and thus thickness, length, quantity, etc. of each component shown may be different from actual ones for convenience of drawing preparation. Moreover, a shape, dimension, etc. of each component shown in the embodiment described above are each just one example, and this disclosure is not limited to them and various alterations can be made thereto within a range not substantially departing from the configuration of this disclosure.

(1) As described with reference to FIG. 1, the image forming apparatus 1 is an electrophotographic color copier, although this disclosure is not limited to this. For example, the image forming apparatus 1 may be a monochromatic copier or a color multifunction peripheral. Moreover, the image forming apparatus 1 may be an inkjet printer. In a case where the image forming apparatus 1 is an inkjet printer, an IC tag is arranged on a circumferential surface of an ink cartridge.

(2) As described with reference to FIGS. 2A and 2B, the IC tags 32 are arranged on the circumferential surfaces of the toner containers 31, but this disclosure is not limited to this.

For example, the IC tags may be arranged on a circumferential surface of a different replacement component. More specifically, they may be arranged on a circumferential surface of the casing where the fixing section 7 (see FIG. 1) is arranged.

(3) As described with reference to FIGS. 2A and 2B, the IC tags 32 are arranged on the end surfaces located at end parts of the toner containers 31 in its detachment direction, but this disclosure is not limited to this. For example, the IC tags 32 may be arranged on side surfaces of the toner containers 31.

(4) As described with reference to FIGS. 2A and 2B, the reader 33 reads the information stored in the IC tags 32, but this disclosure is not limited to this. The reader may be provided with a writer function. More specifically, a reader and writer not only may read the information stored in the IC tag but also may write new information in the IC tag.

(5) As described with reference to FIGS. 2A-4, the IC tags 32 are arranged on the toner containers 31, but this disclosure is not limited to this. In place of the IC tags 32, radio frequency identifier (RFID) tags may be arranged on the toner containers 31.

(6) As described with reference to FIGS. 2A-4, the IC tags 32 includes the first IC tag 321 and the second IC tag 322, but this disclosure is not limited to this. For example, the IC tags 32 include three or more IC tags having mutually different communicable distances. In this case, the IC tag 32 is arranged at a position (a position with a large positional shift distance ΔX) more separate from the position opposite to the reader 33, as the communicable distance of the IC tag 32 increases. In this manner, also in a case where the IC tags 32 include the three or more IC tags having the mutually different communicable distances, the communication between each IC tag 32 and the reader 33 can stably be performed.

(7) As described above with reference to FIG. 5, the distance LA between the IC tag 32 and the reader 33 is set at the center position of the second communicable distance AR2 of the second IC tag 322, but this disclosure is not limited to this. For example, when the communicable distance of the IC tag is from zero mm to 4 mm, the distance LA between the IC tag 32 and the reader 33 may be set at 3 mm. Setting a longer distance LA between the IC tag 32 and the reader 33 can more reduce the positional shift distance ΔX of the first IC tag 321.

What is claimed is:

1. An image forming apparatus having a toner container that is attached thereto and includes a first IC tag, the image forming apparatus comprising:

a container-attaching part and a reader; and a second IC tag being different from the first IC tag, wherein the toner container is attachably and detachably formed at the container-attaching part of the image forming apparatus, the first IC tag is arranged on a circumferential surface of the toner container, the first IC tag makes communication with the reader arranged at the container-attaching part when the toner container is attached to the container-attaching part, the first IC tag cannot make communication with the reader when a distance between the first IC tag and the reader is less than a threshold distance, when the first IC tag is arranged at a position opposite to the reader, the distance between the first IC tag and the reader is shorter than the threshold distance, the first IC tag is arranged at a position separate from the position opposite to the reader, the reader includes an antenna in a rectangular spiral shape with substantially rectangular outer circumference, the first IC tag is arranged at a position separate from the position opposite to the reader in a direction along a long side of the antenna, the first IC tag can make communication with the reader within a range of a first communicable distance from a position of the reader, the first IC tag is located at a longer distance from the position opposite to the reader, as the first communicable distance increases, the second IC tag is arranged on the circumferential surface of the toner container, the second IC tag can make communication with the reader within a range of a second communicable distance, a longest distance of the second communicable distance is shorter than a longest distance of the first communicable distance, and a shortest distance of the second communicable distance is shorter than a shortest distance of the first communicable distance, and a distance between the reader and the circumferential surface of the toner container is set based on the range of the second communicable distance.

2. The image forming apparatus according to claim 1, wherein a distance between the reader and the circumferential surface of the toner container on which the first IC tag is arranged is longer than the shortest distance of the second communicable distance and shorter than the shortest distance of the first communicable distance.

3. The image forming apparatus according to claim 1, wherein the second IC tag is arranged at the position opposite to the reader.

4. The image forming apparatus according to claim 1, wherein the first IC tag and the second IC tag each store identification information of the toner container.

5. The image forming apparatus according to claim 1, wherein the first IC tag and the second IC tag each store at least one of information of a manufacturer's production serial number of the toner container, information of a manufacturing date of the toner container, identification information of a manufacturing plant of the toner container, and property value information of a toner stored in the toner container.

* * * * *